US007435055B2

(12) United States Patent
Hansen et al.

(10) Patent No.: US 7,435,055 B2
(45) Date of Patent: Oct. 14, 2008

(54) LOCKING SPACER ASSEMBLY FOR A TURBINE ENGINE

(75) Inventors: Christian M. Hansen, Simpsonville, SC (US); Alfred P. Matheny, Jupiter, FL (US); Brian Potter, Greenville, SC (US)

(73) Assignee: Siemens Power Generation, Inc., Orlando, FL (US)

( * ) Notice: Subject to any disclaimer, the term of this patent is extended or adjusted under 35 U.S.C. 154(b) by 568 days.

(21) Appl. No.: 11/093,162

(22) Filed: Mar. 29, 2005

(65) Prior Publication Data

US 2006/0222502 A1 Oct. 5, 2006

(51) Int. Cl.
*F01D 5/32* (2006.01)

(52) U.S. Cl. ..... 416/215; 416/220 R

(58) Field of Classification Search ..... 416/215, 416/216

See application file for complete search history.

(56) References Cited

U.S. PATENT DOCUMENTS

| | | | | |
|---|---|---|---|---|
| 3,721,506 | A | 3/1973 | Anderson | |
| 3,954,350 | A | 5/1976 | Zahring | |
| 3,955,898 | A | 5/1976 | Zaehring | |
| 4,859,149 | A | 8/1989 | McClain | |
| H1258 | H | 12/1993 | Hindle, Jr. | |
| 6,464,463 | B2 | 10/2002 | Yvon Goga et al. | |
| 6,638,006 | B2 | 10/2003 | Selby | |
| 6,647,602 | B2 | 11/2003 | Bachofner et al. | |
| 6,752,598 | B2 | 6/2004 | Antunes et al. | |
| 7,192,256 | B2 * | 3/2007 | Bachofner et al. | 416/215 |
| 2001/0055527 | A1 | 12/2001 | Yvon Goga et al. | |
| 2002/0004010 | A1 | 1/2002 | Pedersen et al. | |
| 2002/0106279 | A1 | 8/2002 | Selby | |
| 2003/0002987 | A1 | 1/2003 | Davidson | |
| 2003/0123986 | A1 | 7/2003 | Antunes et al. | |
| 2004/0037703 | A1 | 2/2004 | Arinci et al. | |

* cited by examiner

*Primary Examiner*—Richard Edgar

(57) ABSTRACT

A locking spacer assembly for filling a void between adjacent components in a turbine engine. In at least one embodiment, the locking spacer assembly may be configured to be inserted between adjacent turbine blades in a disc groove in a turbine blade stage assembly. The locking spacer assembly may be formed from fore and aft end supports and a locking device having fore and aft angled surfaces for urging the fore and aft end supports into lateral recesses in the disc groove. The locking spacer assembly may also include a mid spacer positioned between the fore and aft end supports. A retainer may be attached to the locking device to draw the fore and aft angled surfaces of the locking device into contact with the fore and aft support surfaces and urge the first and second end supports into lateral recesses in the disc groove.

18 Claims, 5 Drawing Sheets

LOCKING SPACER ASSEMBLY FOR A TURBINE ENGINE

FIELD OF THE INVENTION

This invention is directed generally to locking spacer assemblies usable in turbine engines, and more particularly to locking spacer assemblies usable in turbine stage assemblies.

BACKGROUND

Typically, gas turbine engines include a compressor for compressing air, a combustor for mixing the compressed air with fuel and igniting the mixture, and a turbine section including a turbine blade assembly for producing power. The compressor and turbine sections of a turbine engine typically include rotors to which a plurality of blades are attached. The plurality of blades are typically arranged in rows spaced axially along the rotor, Each blade is releasably attached to the periphery of a disc.

FIG. 1 depicts a conventional system for attaching blades 1 to a disc 2. The disc 2, shown in partial section, may have various configurations and includes a disc groove 4 extending about the periphery of the disc 2. Each blade 1 includes a root 6 at a base of the blade 1 that is configured to match the shape of the disc groove 4. Each blade 1 is attached to the disc 2 by sliding the root 6 of each blade 1 into the disc groove 4. The disc groove 4 in the disc 2 enables a plurality of blades 1 to be arranged about the periphery of the disc 1. The blades 1 are spaced apart around the disc 2, and the resulting voids in the disc groove 4 between the roots 6 of adjacent blades 1 are filled with spacers 8. The similarity of the size and shape of the blade root 6 and rotor groove 4 keep the blade 1 attached to the disc 2. In addition, the motion of the blade 1 during normal turbine engine operation creates forces in the axial and radial directions that also restrain the blade 1.

The disc groove 4 typically has lateral recesses 5 for receiving corresponding projections 9 extending from the roots 6 of blades 1 and from spacers 8. Engagement of the recesses 5 and projections 7 secure the blades 1 and spacers 8 axially and radially. The configuration of the projections 7 prevent the blades 1 and spacers 8 from being inserted directly into the disc groove 4 in the operational orientation of the blades 1. Instead, the root 6 of a blade 1 must first be rotated 90 degrees and inserted with the projection 7 extending along the disc groove 4. The blade 1 may then be rotated into the final orientation with the projection 7 extending into the lateral recess 5.

A plurality of blades 1 and spacers 8 may be installed in the disc groove 4 as shown in FIG. 1. Once all of the blades 1 and spacers 8 have been installed and the installation process is nearly complete, the remaining space in the disc groove 4 between adjacent blades may be filled and secured. This open space may not be filled with a conventional spacer 8 because there is not sufficient space remaining in the disc groove 4 to permit insertion and rotation of a spacer 8. Instead, spacers formed from multiple components that can be locked into positioned without being rotated into a final position have been used. In some conventional systems, a multi-piece spacer has been used. However, centrifugal forces encountered during operation of the turbine engine can cause these multi-piece spacers to come apart and cause extensive damage to the turbine engine. Conventional designs often suffer from the devices coming apart if either side of the devices develop clearance relative to adjacent turbine components. Another problem often encountered in conventional designs is that the components forming the conventional design often have problems fitting together. Thus, a need exists for a more efficient and reliable device for filling a void between adjacent turbine components and for securing a final spacer for locking turbine blades to a disc.

SUMMARY OF THE INVENTION

This invention relates to a locking spacer assembly configured to fill voids between components in a turbine engine. More specifically, the locking spacer assembly may be used to fill a void between adjacent turbine blade roots positioned in a disc groove of a disc in a turbine stage assembly. The locking spacer assembly may be configured to fit in the void and remain securely positioned within the void during normal turbine engine operation. The locking spacer assembly may be formed from a plurality of components enabling the locking spacer assembly to be assembled within the disc groove. The locking spacer assembly may be formed from a first end support having an outer face and an inner face, wherein the outer face has an outwardly stepped profile adapted to be inserted into a turbine component slot having lateral recesses and to project into one of the lateral recesses. The first end support may also include a cavity having a first support surface. The locking spacer assembly may also include a second end support having an outer face and an inner face, wherein the outer face has an outwardly stepped profile adapted to be inserted into the turbine component slot having lateral recesses and to project into one of the lateral recesses. The second end support may include a cavity having a second support surface, and the inner faces of the first and second end supports may be configured to face each other once installed in the void.

The locking assembly may also include a locking device disposed between the first and second end supports. The locking device may include first and second angled surfaces configured to bear against the support surfaces of the first and second end supports such that as the locking device is moved relative to the first and second end supports while keeping the locking device in contact with the first and second end supports, at least one force vector is developed that urges the first and second end supports away from each other and into the lateral recesses of the turbine component.

The locking assembly may also include a mid spacer positioned between the first and second end supports. The mid spacer may include at least one cavity for receiving the locking device. The cavity may be configured to prevent the locking device from rotating, thereby preventing the locking device assembly from undesirably disassembling during turbine engine operation. The locking device may extend through the spacer to receive a retainer, which may be, but is not limited to being, a nut. The mid spacer may also include a cavity for housing the retainer. The mid spacer may also include fore and aft wings configured to fit within cavities in the first and second end supports to limit movement of the first and second end supports relative to the mid spacer.

The support surfaces of the first and second end supports may be configured to mate with the first and second angled surfaces of the locking device. In at least one embodiment, the first and second angled surfaces of the locking device may be formed from a portion of a conical surface. The angled support surfaces urge the first and second end supports generally orthogonal to a longitudinal axis of the locking device and into contact with the disc.

The locking assembly may be assembled in a void between turbine blades by inserting the first and second end supports into the void and moving the stepped profiles of the supports into the lateral recesses in the disc groove. The locking device may be inserted into the void between the first and second end supports and rotated into position so that the first and second angled surfaces of the locking device contact the first and second support surfaces of the first and second end supports. The mid spacer may be inserted between the first and second end supports. In at least one embodiment, the locking device may extend through the mid spacer enabling the retainer to be attached to the locking device. The locking device may be actuated by rotating the retainer on the locking device causing the first and second angled surfaces of the locking device to contact the first and second support surfaces of the first and second end supports. The angled surfaces may cause the first and second end supports to be urged away from the locking device and into the lateral recesses of the disc groove where the stepped profiles of the outer faces of the first and second end supports contact the disc.

An advantage of this invention is that the locking spacer assembly is actuated without interaction with adjacent turbine blades; thus, enabling the locking spacer assembly to be self-sustaining.

Another advantage of this invention is that the locking device includes fore and aft angled surfaces for engaging the fore and aft end supports and wedging the fore and aft end supports into the lateral recesses of a disc groove. The spacer assembly includes a cavity receiving the locking device and preventing the locking device from rotating thereby preventing unwanted disassembly of the locking spacer assembly during turbine engine operation.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
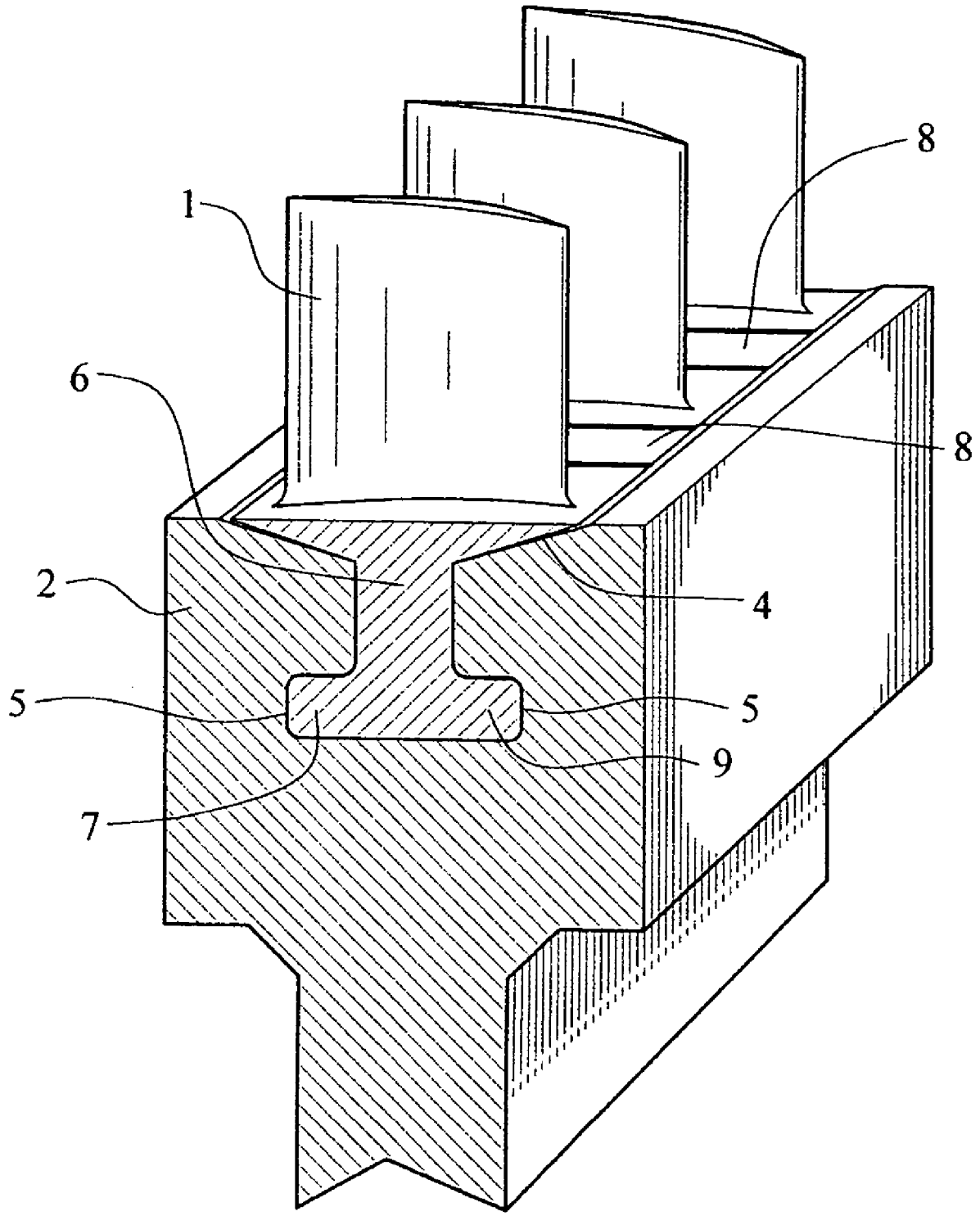
FIG. 1 (PRIOR ART)
FIG. 1 is a perspective view of a conventional partial stage assembly including a disc, a plurality of turbine blades, and a plurality of spacers.

As shown in FIGS. 2-5, this invention is directed to a locking spacer assembly 10 usable to fill a void in a turbine component slot 12 having lateral recesses 14. In at least one embodiment, the locking spacer assembly 10 may be configured to be a final component installed in a disc groove 16 to prevent a plurality of turbine blades 22 from detaching from a disc 18 in a turbine stage assembly 20. The locking spacer assembly 10 may be configured such that the disc groove 16 be continuous throughout its length and need not include a portion having a different configuration for attachment of the locking spacer assembly 10. The locking spacer assembly 10 may be installed and actuated without interaction with adjacent turbine blades 18, thereby preventing failure if clearance develops on either side of the assembly 10 proximate to the adjacent turbine blades 22. The locking spacer assembly 10 may remain assembled and in place during all operating stages of a turbine engine.

Figure 2:
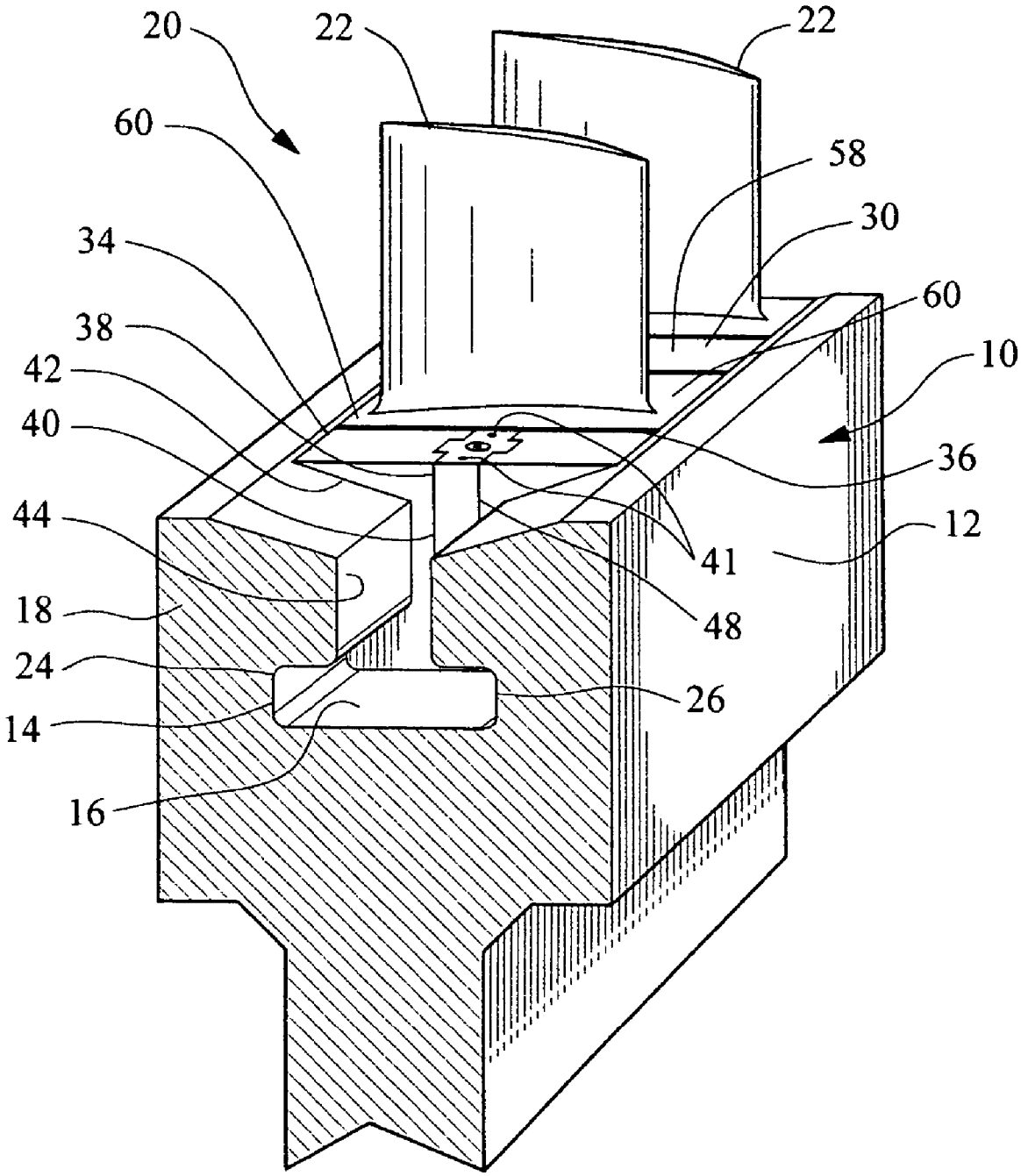
FIG. 2 is a perspective view of a locking spacer assembly of this invention installed in a stage assembly.

As shown in FIG. 2, a turbine stage assembly 10 may be formed from a disc 18 with a disc groove 16. The disc 18 may have a generally circular configuration forming a circular member from one or more components. The disc groove 16 may extend throughout the length of the disc 18 and be configured to retain turbine blades 22 during operation of a turbine engine. As shown in FIG. 2, the disc groove 16 may include lateral recesses 24, 26 on either side of the groove 16 for retaining the roots of turbine blades 22. A disc 18 may be filled with a plurality of alternating turbine blades 22 and spacers 30. The turbine blades 22 and spacers 30 may be installed by inserting the roots of the blades 22 and spacers 30 one at a time into the disc groove 16 and rotating the blades 22 and spacers 30 about ninety degrees until the roots engage the disc 18. The final opening, or void, in the turbine stage assembly 10 may be filled with the locking spacer assembly 10.

Figure 3:
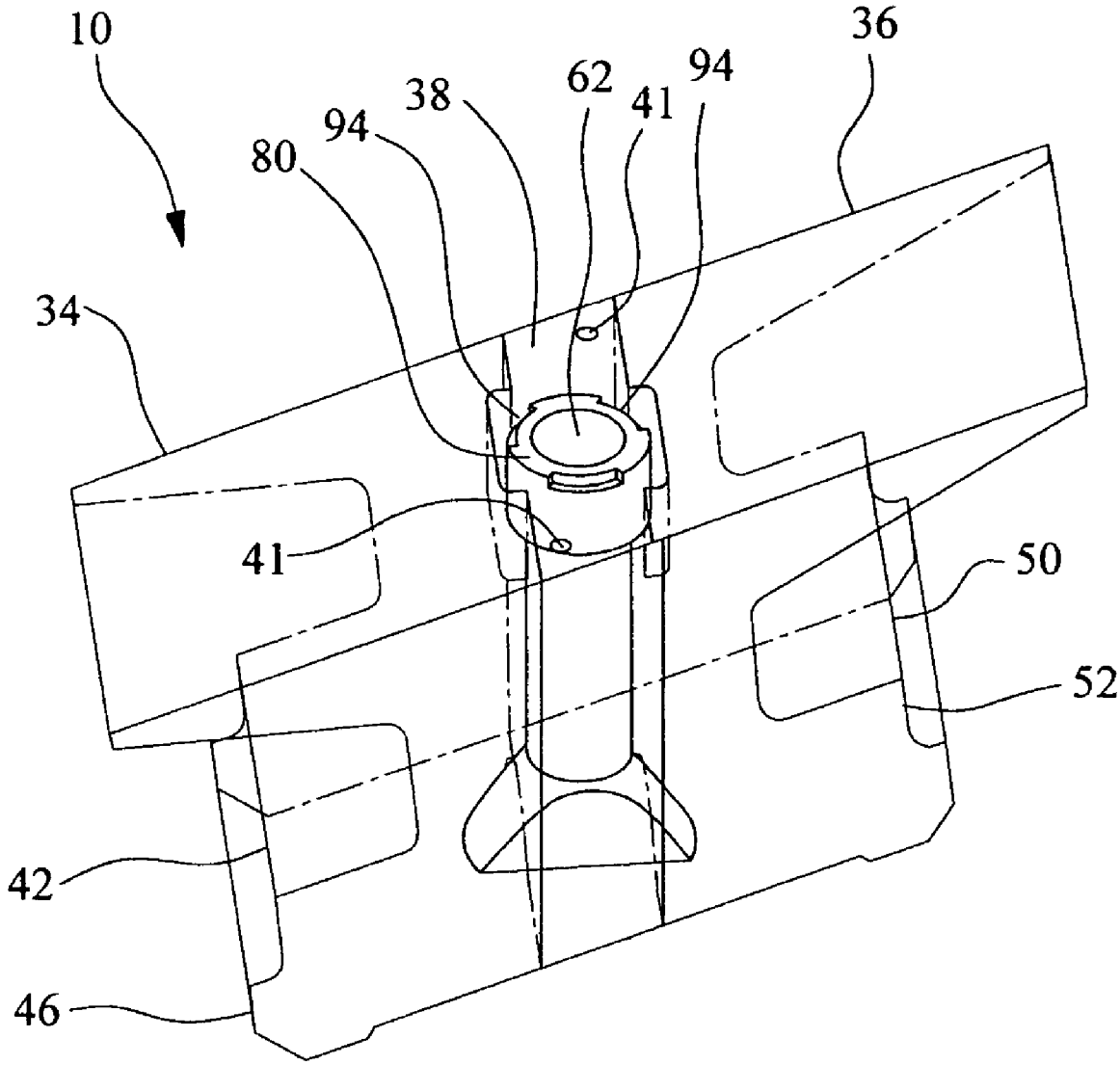
FIG. 3 is a perspective view of the locking spacer assembly of this invention.
Figure 4:
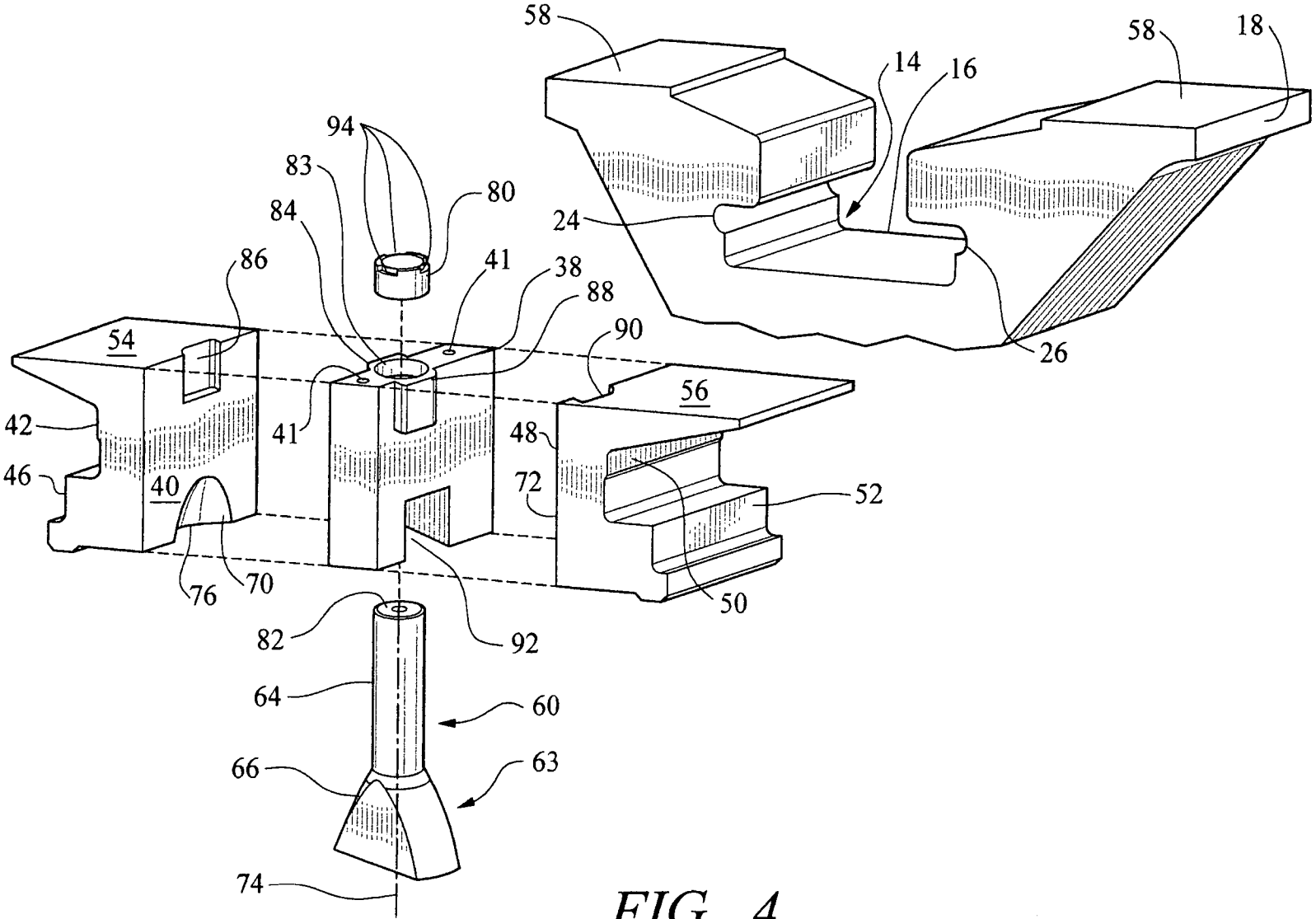
FIG. 4 is an exploded perspective view of the locking spacer assembly of this invention shown in FIG. 3.
Figure 5:
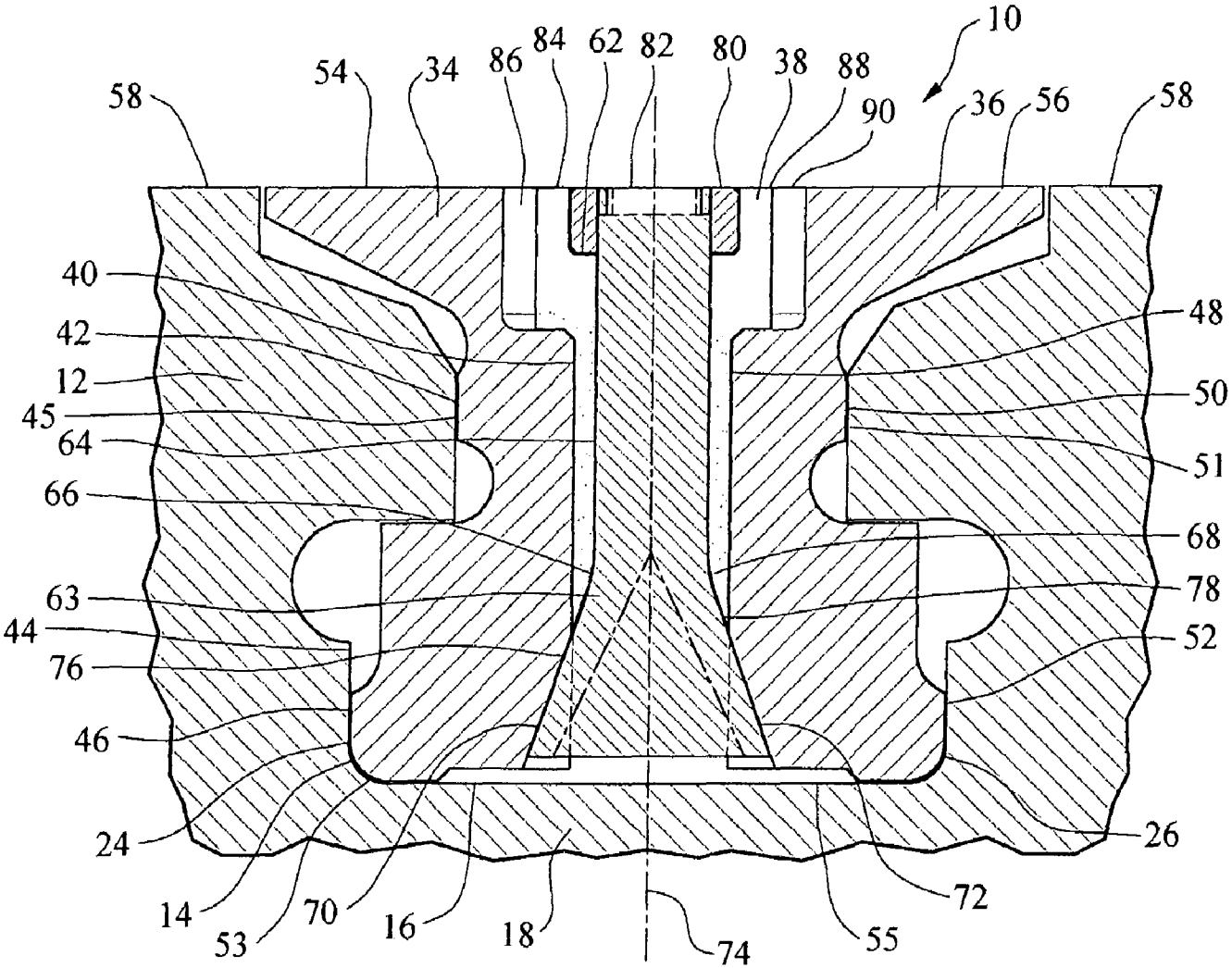
FIG. 5 is a cross-sectional view of the locking spacer assembly shown in FIG. 3 taken along section line 5-5.

In at least one embodiment, the locking spacer assembly 10 may be formed from multiple components. For instance, as shown in FIGS. 3-5, the locking spacer assembly 10 may be formed from a fore end support 34 and an aft end support 36, which may be separated by a mid spacer 38. The fore end support 34 may include an inner face 40 and an outer face 42. The outer face 42 may have a stepped profile, as shown in FIG. 4, configured to mate with the profile of the surface 44 of the disc groove 16. In particular, the stepped profile of the outer face 42 may include at least one upper lateral projection 45 and one lower lateral projection 46. The upper and lower lateral projections 45, 46 may be configured to contact the surface 44 of the disc groove 16 when installed in the disc groove 16 to prevent the locking spacer assembly 10 from rotating out of the disc groove 16.

In a similar manner, the aft end support 36 may include an inner face 48 and outer face 50 with a stepped profile configured to mate with the surface 44 of disc groove 16 generally opposite to the fore end support 34. In particular, the stepped profile of the outer face 50 may include at least one upper lateral projection 51 and one lower lateral projection 52. The upper and lower lateral projections 51, 52 may be configured to contact the surface 44 of the disc groove 16 when installed in the disc groove 16 to prevent the locking spacer assembly 10 from rotating out of the disc groove 16. The fore and aft end supports 34, 36 may include upper surfaces 54, 56, respectively, configured to fit flush with the outer surfaces 58 of the adjacent platforms 60 of the turbine blades 22. Bottom surfaces 53 and 55 of the fore and aft end supports 34, 36, may be configured to contact the disc groove 16 when installed in the disc groove 16 to facilitate the alignment of the upper surfaces 54, 56, respectively, with the outer surfaces 58.

The fore and aft end supports 34, 36 may be positioned within the void in the disc groove 16 using at least one locking device 62. In at least one embodiment, as shown in FIG. 4, the locking device 62 may be formed from a shaft 64 for urging the fore and aft end supports 34, 36 into the lateral recesses 14 of the disc groove 16. The shaft may include a cam 63 formed from a fore angled surface 66 for mating with the fore end support 34 and an aft angled surface 68 for mating with the aft end support 36. In at least one embodiment, the fore end support 34 may include a fore support surface 70 adapted to be contacted by the fore angled surface 66 of the locking device 62, and the aft end support 36 may include an aft support surface 72 adapted to be contacted by the aft angled surface 68 of the locking device 62.

The fore and aft angled surfaces 66, 68 of the locking device 62 may have any configuration capable of urging the aft and fore end supports 34, 36 toward the lateral recesses 14 of the disc groove 16. In at least one embodiment, the fore and aft angled surfaces 66, 68 of the locking device 62 may be formed from at least a portion of a conical surface, as shown in FIGS. 4 and 5. The conical surface reduces stress concentrations and improves durability. The fore and aft angled surfaces 66, 68 of the locking device 62 are configured such that when the locking device is moved along a longitudinal axis 74 of the locking device 62, the fore and aft end supports 34, 36 are urged into the lateral recesses 14 of the disc groove 16. The fore and aft angled surfaces 66, 68 of the locking device 62 may be positioned between about 10 degrees and about 75 degrees relative to the longitudinal axis 74 of the shaft 64. In addition to extending at an angle relative to the longitudinal axis 74, the fore and aft angled surfaces 66, 68 of the locking device 62 may be curved in a conical formation that may or may not have a center along the longitudinal axis 74 of the shaft 64. The fore and aft support surfaces 70, 72 of the fore and aft end supports 34, 36 may be positioned in cavities 76, 78, respectively. In addition, the fore and aft support surfaces 70, 72 of the fore and aft end supports 34, 36 may be concave partial conical surfaces adapted to mate with the locking device 62.

The locking device 62 may be fixed into position through use of a retainer 80. In at least one embodiment, the retainer 80 may be releasably coupled to an end 82 of the shaft 64. The retainer 80 may be, but is not limited to being, a bolt threadably attached to the locking device 62. In at least one embodiment, the retainer 80 may be positioned in a cavity 83 in the mid spacer 38. The retainer 80 may include recesses 94 in the retainer 80 configured for engagement by a tool for rotating the retainer 80 on the locking device 62. In the embodiment shown in FIG. 5, the retainer 80 may urge the fore and aft end supports 34, 36 into the lateral recesses 24, 26 to lock the locking spacer assembly into place 10. More specifically, the retainer 80 may be tightened against the mid spacer 38. As the retainer 80 is tightened, the fore and aft angled surfaces 66, 68 bear against the fore and aft support surfaces 70, 72 causing the fore and aft end supports 34, 36 to move generally orthogonally away from the longitudinal axis 74 of the shaft 64.

The embodiment shown in FIG. 5 depicts a locking spacer assembly 10 in which the locking device 62 is drawn toward the retainer 80. However, in an alternative embodiment, not shown, the locking spacer assembly 10 may be configured such that the fore and aft end supports 34, 36 may be urged into engagement with the disc 18 by unscrewing the retainer 80 from the shaft 62. Thus, the configuration of the fore and aft angled surfaces 66, 68 may be inverted such that the locking device resembles a shaft with an arrow head rather than a Y shape shown in FIGS. 3-5. In addition, the retainer 80 may bear against the mid spacer 38 so that as the retainer 80 is backed off of the shaft 64, the fore and aft angled surfaces 66, 68 are urged into contact with the fore and aft support surfaces 70, 72 of the fore and aft end supports 34, 36, respectively. In turn, the fore and aft end supports 34, 36 are urged into contact with the disc 18.

The mid spacer 38 may be sized appropriately to fit between the fore and aft end supports 34, 36. As shown in FIG. 4, the mid spacer 38 may include a fore wing 84 that corresponds with a wing cavity 86 in the fore end support 34. The mid spacer 38 may also include an aft wing 88 corresponding with a wing cavity 90. The fore and aft wings 84, 88 may prevent, or at least substantially limit, movement of the fore and aft end supports 34, 36 relative to the mid spacer 38 along the disc groove 16. The mid spacer 38 may also include a locking device cavity 92 extending through the mid spacer 38 for containing the locking device 62. The locking device cavity 92 may be sized to contain a portion of the fore and aft angled surfaces 66, 68. The locking device cavity 92 may also prevent disengagement of the locking device 62 from the fore and aft end supports 34, 36. The mid spacer 38 may also include extraction ports 41 adapted to facilitate removal of the mid spacer 38 during disassembly. The extraction ports 41 may be threaded to accept a threaded rod.

The locking spacer assembly 10 may be used to fill a void in a turbine component slot 12 having lateral recesses 14. The locking spacer assembly 10 may be assembled by inserting a fore end support 34 into the void, whereby the outwardly stepped profile of the outer face 42 is inserted into the lateral recess 24. An aft end support 36 may be inserted into the void so that the outwardly stepped profile of the outer face 50 is inserted into the lateral recess 24 and the inner faces 40, 48 of the fore and aft end supports 34, 36 face each other. The locking device 62 may be inserted into the void between the fore and aft end supports 34, 36. The locking device 62 may be rotated so that the aft and fore angled surfaces 66, 68 of the locking device 62 engage the fore and aft support surfaces 70, 72 of the fore and aft end supports 34, 36. The mid spacer 38 may be inserted into the void and aligned so that the locking device 62 protrudes through the locking device cavity 92. A retainer 80 may be attached to the locking device 62. The retainer 80 may be actuated by rotating the retainer and drawing the fore and aft angled surfaces 66, 68 of the locking device 62 into contact with the fore and aft end supports 34, 36, thereby urging the fore and aft end supports 34, 36 into the lateral recesses 24, 26 of the disc groove 16. Such action tightens the fore and aft end supports 34, 36 against the disc groove. After the retainer 80 has been torqued accordingly, the retainer 80 may be aligned with sides of the mid spacer 38 enabling the surface of the mid spacer 38 to be caulked.

Once the locking spacer assembly 10 has been installed, the locking spacer assembly 10 may remain installed in the void in the disc groove 16 throughout the life cycle of the disc 18 and other components. The locking spacer assembly 10 may be removed to service the turbine blades 22 by removing the retainer 80 and disassembling the locking spacer assembly 10. A tool may be inserted into the extraction ports 41 in the mid spacer 38 to facilitate removal of the mid spacer 38 and other components forming the locking spacer assembly.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A locking spacer assembly for filling a void in a turbine component having lateral recesses, comprising:

a first end support having an outer face and an inner face, the outer face having an outwardly stepped profile, whereby the first end support is adapted to be inserted into a turbine component slot having lateral recesses and to project into one of the lateral recesses;

a second end support having an outer face and an inner face, the outer face having an outwardly stepped profile, whereby the second end support is adapted to be inserted into the turbine component slot having lateral recesses and to project into one of the lateral recesses, wherein the inner faces of the first and second end supports face each other; and a locking device disposed between the first and second end supports and having at least one angled surface configured to bear against a support surface of an end support such that as the angled surface is moved relative to the first and second end supports while keeping the locking device in contact with the first and second end supports, the first and second end supports move away from each other and into the lateral recesses of the turbine component; and at least one retainer for engaging the locking device against the support surface and retaining the locking device in a locked position.

2. The locking spacer assembly of claim 1, wherein the support surface of an end support is positioned on the first end support and is configured to mate with the at least one angled surface of the locking device, wherein the support surface forms a cavity in the first end support.

3. The locking spacer assembly of claim 2, wherein the support surface of an end support is positioned on the second end support and is configured to mate with the at least one angled surface of the locking device, wherein the support surface forms a cavity in the second end support.

4. The locking spacer assembly of claim 1, wherein the at least one angled surface of the locking device comprises a first angled surface extending from the locking device and a second angled surface extending from the locking device and generally opposing the first angled surface.

5. The locking spacer assembly of claim 4, wherein the angled surfaces of the first and second angled surfaces form at least a portion of a conical surface.

6. The locking spacer assembly of claim 1, further comprising at least one mid spacer positioned between the first and second end supports and including at least one cavity for receiving locking device.

7. The locking spacer assembly of claim 6, wherein the at least one mid spacer further comprises at least one wing extending from the mid spacer for engaging the first end support and at least one wing extending from the mid spacer for engaging the second end support.

8. The locking spacer assembly of claim 6, further comprising at least one cavity in the mid spacer for receiving at least a portion of the at least one retainer.

9. A locking spacer assembly for filling a void in a turbine component having lateral recesses, comprising:

a first end support having an outer face and an inner face, the outer face having an outwardly stepped profile, whereby the first end support is adapted to be inserted into a turbine component slot having lateral recesses and to project into one of the lateral recesses, and wherein the first end support includes a cavity having a first support surface;

a second end support having an outer face and an inner face, the outer face having an outwardly stepped profile, whereby the second end support is adapted to be inserted into the turbine component slot having lateral recesses and to project into one of the lateral recesses, wherein the second end support includes a cavity having a second support surface and wherein the inner faces of the first and second end supports face each other;

a locking device disposed between the first and second end supports and having at least first and second angled surfaces configured to bear against the support surfaces of the first and second end supports such that as the locking device is moved relative to the first and second end supports while keeping the locking device in contact with the first and second end supports, the first and second end supports move away from each other and into the lateral recesses of the turbine component; and at least one mid spacer positioned between the first and second end supports and including at least one cavity for receiving locking device and for substantially limiting the locking device from rotating.

10. The locking spacer assembly of claim 9, wherein the angled surfaces of the first and second angled surfaces each form portions of a conical surface.

11. The locking spacer assembly of claim 9, wherein the at least one mid spacer further comprises at least one wing extending from the mid spacer for engaging the first end support and at least one wing extending from the mid spacer for engaging the second end support.

12. The locking spacer assembly of claim 9, further comprising at least one retainer attached to the locking device for engaging the locking device against the support surface and retaining the locking device in a locked position.

13. The locking spacer assembly of claim 12, further comprising at least one cavity in the mid spacer for receiving at least a portion of the at least one retainer.

14. The locking spacer assembly of claim 9, further comprising at least one cavity in the at least one mid spacer for receiving a portion of the locking device including the first and second angled surfaces and preventing the locking device from rotating.

15. A method of filling a void in a turbine component slot having lateral recesses, comprising:

inserting a first end support into the void in the turbine component slot, wherein the first end support has an outer face and an inner face, the outer face having an outwardly stepped profile, whereby the first end support is adapted to be inserted into the turbine component slot having lateral recesses and to project into one of the lateral recesses, and wherein the first end support includes a cavity having a first support surface;

inserting a second end support into the void in the turbine component slot proximate to the first end support, wherein the second end support has an outer face and an inner face, the outer face having an outwardly stepped profile, whereby the second end support is adapted to be inserted into the turbine component slot having lateral recesses and to project into one of the lateral recesses, wherein the second end support includes a cavity having a second support surface and wherein the inner faces of the first and second end supports face each other;

inserting a locking device into the turbine component slot between the first and second end supports, wherein the locking device has at least first and second angled surfaces configured to bear against the support surfaces of first and second end supports; rotating the locking device so that the first and second angled surfaces bear against the support surfaces of first and second end supports; and actuating the locking device so that the first and second end supports move away from each other and into the lateral recesses of the turbine component by contacting the first angled surface of the locking device with the first support surface of the first end support and by contacting the second angled surface of the locking device with the second support surface of the second end support.

16. The method of claim 15, wherein actuating the locking device comprises tightening a retainer onto the locking device causing the first and second angled surfaces of the locking device to contact the first and second support surfaces of the first and second end supports and to drive the first and second support surfaces generally away from each other and into the lateral recesses of the turbine component.

17. The method of claim 15, further comprising inserting at least one mid spacer between the first and second end supports, wherein the at least one mid spacer includes at least one cavity for housing the locking device.

18. The method of claim 17, wherein inserting at least one mid spacer between the first and second end supports further comprises inserting a mid spacer having at least one wing extending from the mid spacer for engaging the first end support and at least one wing extending from the mid spacer for engaging the second end support.

* * * * *